United States Patent [19]

Pearlman

[11] 3,965,789

[45] June 29, 1976

[54] ELECTRONIC MUSICAL INSTRUMENT EFFECTS CONTROL

[75] Inventor: Alan R. Pearlman, Newton Highlands, Mass.

[73] Assignee: ARP Instruments, Inc., Newton, Mass.

[22] Filed: Feb. 1, 1974

[21] Appl. No.: 438,780

[52] U.S. Cl. ..... 84/1.24; 84/1.25; 84/1.27; 84/DIG. 7

[51] Int. Cl.[2] ..... G10H 1/04; G10H 5/02

[58] Field of Search ..... 84/1.01, 1.09, 1.1, 84/1.13, 1.24–1.27, DIG. 7, DIG. 8; 333/70 S

[56] References Cited

UNITED STATES PATENTS

| | | | |
|---|---|---|---|
| 3,250,843 | 5/1966 | Jenny | 84/1.09 |
| 3,439,106 | 4/1969 | Goodale | 84/1.27 |
| 3,490,327 | 1/1970 | Volpe | 84/1.25 |
| 3,524,375 | 8/1970 | Hopping | 84/1.13 |
| 3,553,336 | 1/1971 | Markowitz et al. | 84/1.09 |
| 3,570,357 | 3/1971 | Adachi | 84/1.26 |
| 3,571,481 | 3/1971 | Adachi | 84/1.13 |
| 3,609,203 | 9/1971 | Adachi | 84/1.01 |
| 3,624,583 | 11/1971 | Nakada | 84/1.24 X |
| 3,624,584 | 11/1971 | Ohno | 84/1.24 X |
| 3,651,729 | 3/1972 | Adachi | 84/1.24 X |
| 3,659,031 | 4/1972 | Adachi | 84/1.01 |
| 3,715,445 | 2/1973 | Kniepkamp | 84/1.13 |
| 3,784,935 | 1/1974 | Pearlman et al. | 333/70 S X |
| 3,819,843 | 6/1974 | Okamoto | 84/1.1 |
| 3,828,110 | 8/1974 | Colin | 84/1.01 |
| 3,835,237 | 9/1974 | Adachi | 84/1.24 |

*Primary Examiner*—L. T. Hix
*Assistant Examiner*—Stanley J. Witkowski

[57] ABSTRACT

The keyboard type instrument includes circuitry for controlling an envelope generator and a voltage controlled oscillator which in sequence operates a voltage controlled filter, and a voltage controlled amplifier both of which receive control signals from the envelope generator. The keys of the keyboard preferably have a common variable conductance touch sensor or transducer associated therewith which is responsive to key depression pressure in excess of a predetermined threshold pressure to control one or more audible characteristics of the played note. In one embodiment vibrato, pitchbend, brilliance and volume of the note are controllable. Associated with the keyboard is selection means including a plurality of audible characteristic selectors and variable means delimiting the range of the audible characteristics. The playing of a note at less than the threshold pressure provides the usual audible pitch and applied pressure above the threshold pressure introduces one or more of the audible characteristics at an intensity that is dependent upon the applied pressure and the setting of the variable control means associated with the keyboard.

6 Claims, 12 Drawing Figures

16
12
TOUCH SENSOR EFFECTS
PITCH BEND
WOW
GROWL
BRIL
VOL
VIB
REEDS
WOODWINDS
BRASS
STRINGS
PERCUSSION
TOUCH SENSITIVITY
14
15
10

40
36
30
38

40
CONTACTS
CLOSED
P1
36
30
38

40
CONTACTS
CLOSED
WITH
OVERTRAVEL
P2
36
30
38

ELECTRONIC MUSICAL INSTRUMENT EFFECTS CONTROL

BACKGROUND OF THE INVENTION

The present invention relates in general to a variable conductance touch sensor or transducer associated with the keys of a keyboard electronic musical instrument. More particularly, this invention pertains to an electronic musical instrument employing the aforesaid transducer and including a plurality of individual selectors for selecting different audible characteristics such as vibrato and/or brilliance, and variable control means that is settable for delimiting the effective range of the selection means.

In the prior art there is shown a key contact system for electronic organs employing a variable conductance element. See, for example, the Lester U.S. Pat. No. 2,848,920. This prior art structure basically discloses the use of spaced conductive bars which are bridged by a variable conductance element when the element contacts these bars. Until the bars are bridged there is no electrical path provided and there is no instrument output. When the bars are bridged the conductance between the bars is immediately variable in accordance with applied pressure. This sensor arrangement is used to control volume and there is no "deadband" of applied pressure over which a normal volume output occurs. Instead, each time a slightly different pressure is applied a different volume output occurs.

Accordingly, it is the purpose of the present invention to overcome this problem and provide in accordance with one aspect of this invention, an instrument wherein a note can be played upon the application of a first minimum predetermined pressure and one or more audible characteristics can be introduced upon the application of a pressure in excess of a second higher predetermined threshold pressure. With the system of this invention there is provided a deadband over which normal playing occurs. It is only when the musician desires to introduce a previously selectable audible characteristic that the note is played harder to introduce that characteristic in a variable manner in accordance with applied pressure.

Another object of the present invention is to provide in association with the touch sensor arrangement of this invention, selection means for selecting one or more of a plurality of different audible characteristics that may be introduced by selection thereof. In addition, there may also be provided in association with the selection means a variable control means that may be movable through different settings by the musician to limit the operating effectiveness of the touch sensor arrangement. This variable control means may be a single control common to all audible characteristics or there may be provided separate variable control for each audible characteristic.

SUMMARY OF THE INVENTION

To accomplish the foregoing and other objects of this invention there is provided an improvement for an electronic musical instrument having a keyboard, means coupled from the keyboard for providing an audio signal, and means responsive to the audio signal for generating an audible tone corresponding to the played key. The improvement comprises transducer means operatively associated with the keyboard and having a conductance that is variable in accordance with the pressure applied to a key of the keyboard, means coupled from the transducer means for establishing a control voltage level corresponding to the conductance of the transducer means and a plurality of separate selection means responsive to the control voltage level and at least one of which may be selectable. The improvement may further comprise a variable control means useable in association with the selection means for altering the control voltage level so as to provide a variable range of effects for use of the transducer means.

In one embodiment of the invention the keyboard typically has associated therewith one switch member per key which, when closed, initiates the envelope waveform. The variable conductance touch sensor arrangement associated with the keyboard is operable only after a predetermined threshold pressure is reached at which time the sensor effectively closes and variable conductance occurs. This variable conductance is transformed into a variable control voltage level. A variable control member such as a potentiometer may be coupled to the control voltage bus to provide lower control voltages. The variable control voltage level may then selectably control a number of individual circuits for altering the audio waveform such as by changing volume, vibrato, pitchbend, or brilliance.

BRIEF DESCRIPTION OF THE DRAWINGS

Numerous other objects, features and advantages of the invention will now become apparent upon a reading of the following detailed description taken in conjunction with the accompanying drawings, in which.

DETAILED DESCRIPTION

Figure 1:
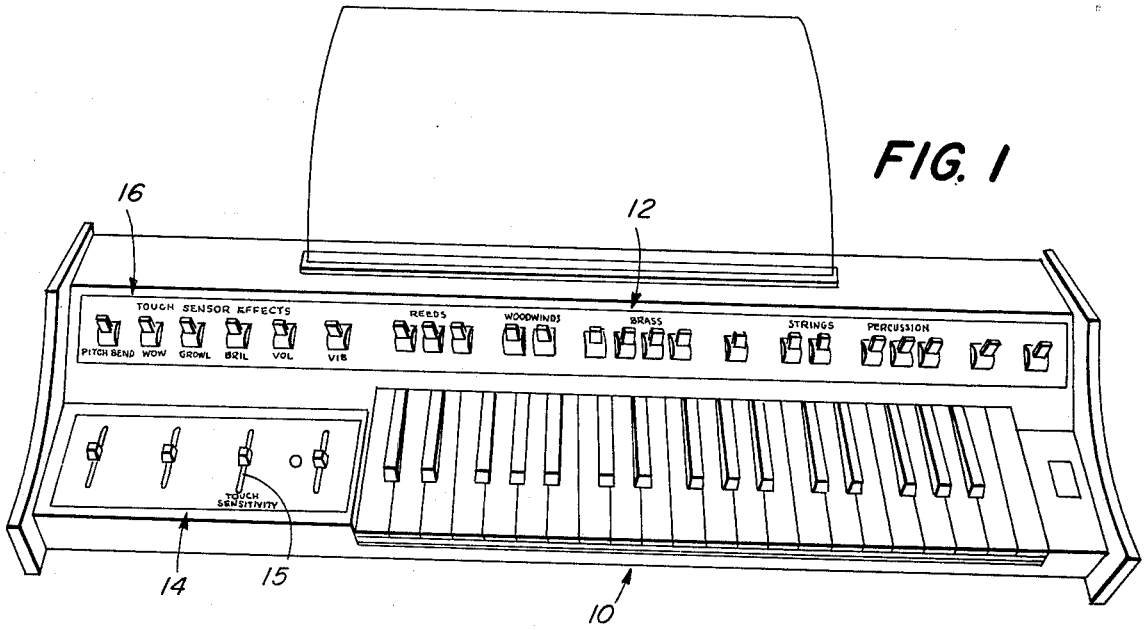
FIG. 1 is a perspective view showing the keyboard and associated controls for an instrument embodying the prinicples of the present invention.

FIG. 1 shows the keyboard 10 and associated switch controls of an instrument embodying the principles of the present invention. Associated with the keyboard 10 is a switch array 12 for providing different instrument sounds, a variable control array 14, and a touch sensor selection array 16. Array 14 includes a slide potentiometer 15 for providing variable touch sensitivity.

The array 16 includes in the embodiment shown in FIG. 1 six selection switches for respectively or conjointly selecting pitchbend, wow, growl, brilliance, volume, and/or vibrato. Some of the controls shown in FIG. 1 are discussed in more detail hereinafter with reference to FIG. 2.

Figure 5A:
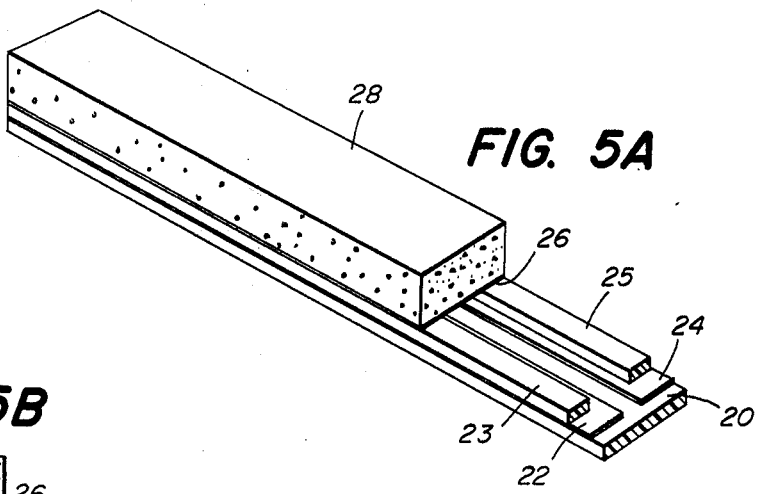
FIG. 5A is a perspective view of the transducer of this invention.
Figure 5B:
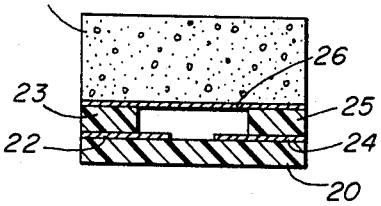
FIG. 5B is a cross-sectional view through the transducer shown in FIG. 5A in a nondepressed condition.
Figure 5C:
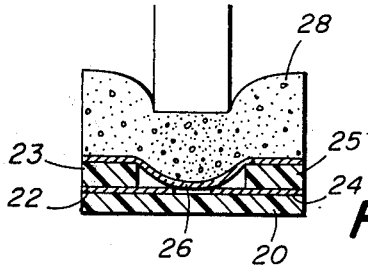
FIG. 5C is a view similar to that shown in FIG. 5B with the transducer in a depressed condition.

FIG. 5A is a partially cutaway perspective view of the touch sensor transducer of the present invention. This transducer extends along the length of the keyboard and thus has an elongated shape wherein pressure may be applied from the depressed keys anywhere along the length of the transducer. FIGS. 5B and 5C are cross-sectional views through the transducer shown in FIG. 5A with no pressure applied and with a predetermined pressure applied, respectively. The basic structure of the transducer is shown in U.S. Pat. No. 3,784,935.

The transducer generally comprises a base 20, metalic foil strips 22 and 24, a flexible conductive plastic layer 26, and a resilient foam or felt strip 28. The base 20 may be a printed circuit board that is copper clad and is etched to define the two foil strips 22 and 24. Insulator strips 23 and 25 are disposed above the respective strips 22 and 24 and the plastic sheet 26 is adhesively fixed to the top edges of the insulators 23 and 25. The foam or felt strip 28 is also adhesively affixed to the top surface of the conductive plastic strip 26.

FIG. 5B shows the strip 26 in a non-pressure condition wherein it is not contacting across the foil strips 22 and 24. In FIG. 5C a pressure has been applied by way of one of the keys of the keyboard and a contact now exists between the strips 22 and 24. The contact area and thus the conductance between these two strips varies in accordance with the applied pressure so that the conductance increases with increasing pressure. See FIG. 4A.

Figure 2:
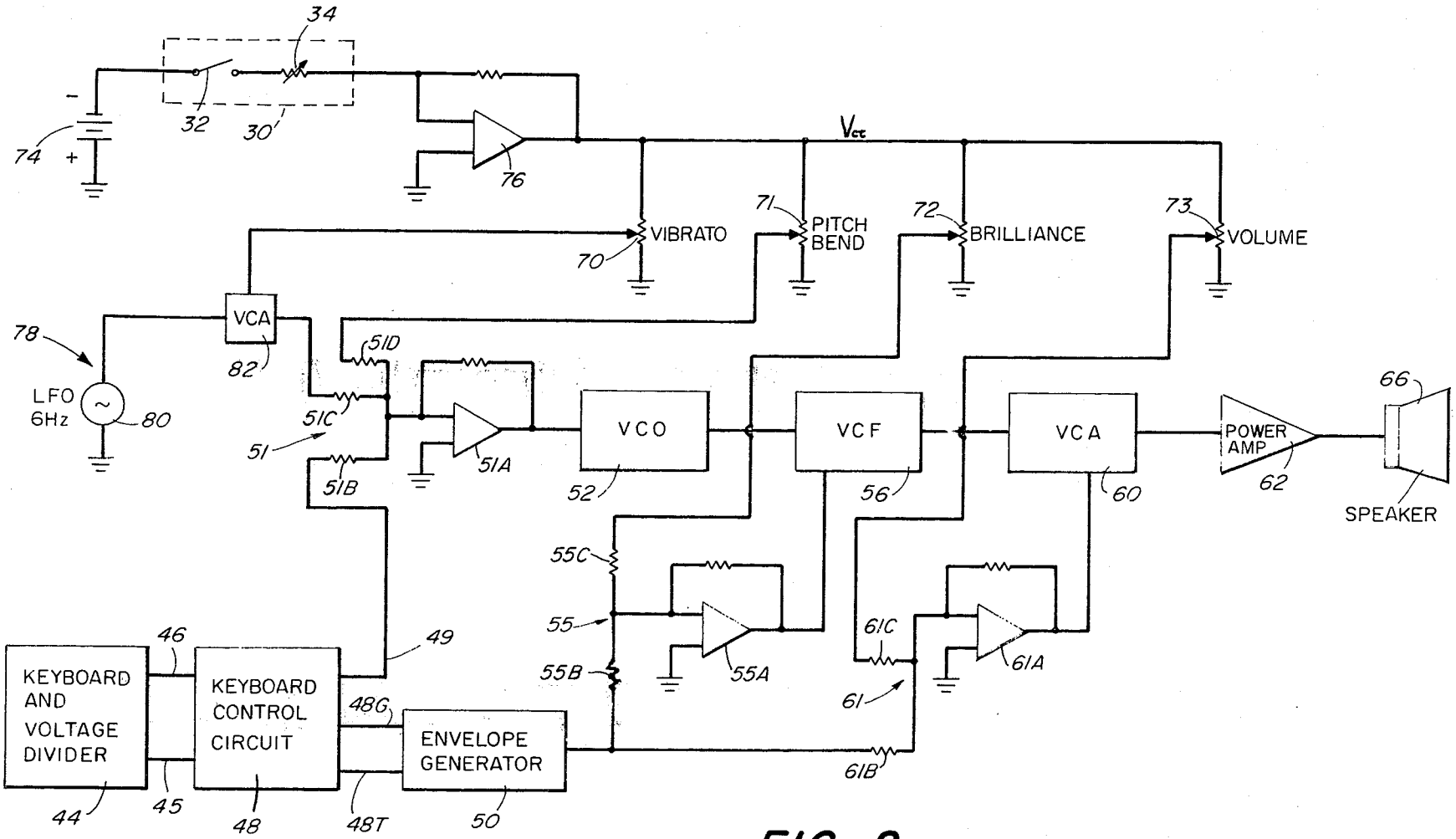
FIG. 2 is a circuit block diagram of the system of this invention.

It is noted that in accordance with this invention the transducer is common to preferably all of the keys of the keyboard. FIG. 2 shows the electrical equivalent of the transducer in dotted outline 30. In FIG. 2 the transducer is represented electrically as a switch 32 in series with a variable resistor 34. The switch 32 closes when the variable conductance strip 26 bridges the strips 22 and 24 and the variable resistor 34 is variable in accordance with applied pressure thereafter.

Figure 3A:
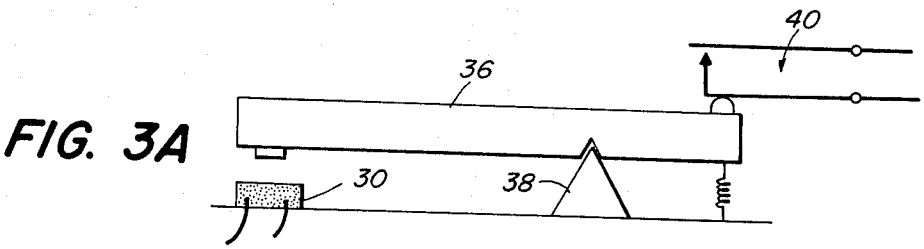
FIGS. 3A – 3C show the key assembly of this invention with the key in three different positions.
Figure 3B:
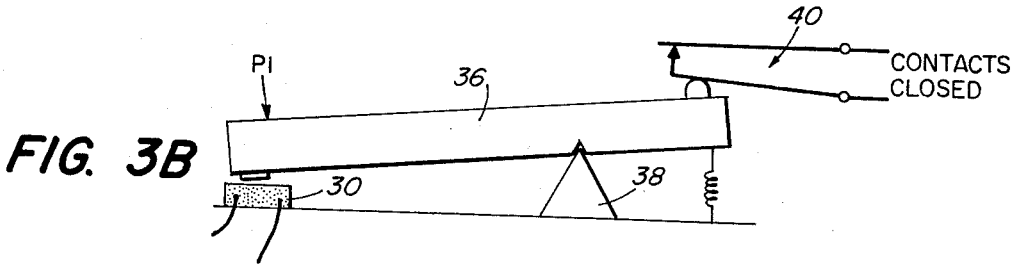
Figure 3C:
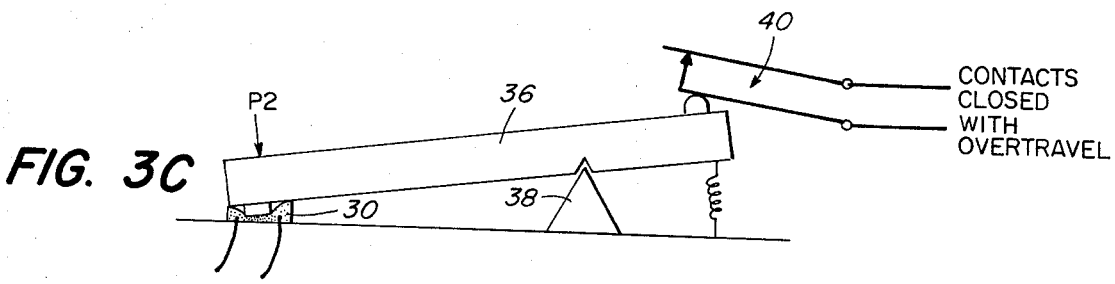

FIGS. 3A – 3C show one of the keys 36 of the keyboard 10 in three different positions. The key 36 is schematically shown as being pivoted at fulcrum member 38. A switch contact 40 is disposed at the right end of the key 36 and in FIG. 3A is shown in its open position with no pressure being applied to the left end of the key. Note also in FIG. 3A that the transducer 30 is spaced from the key 36 and is thus also in its open condition.

Figure 4A:
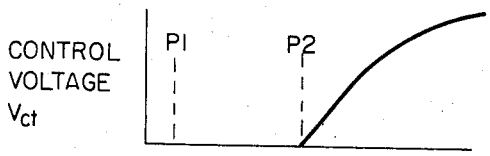
FIGS. 4A – 4D show various waveforms associated with the invention.

In FIG. 3B the contact 40 is shown closed as a predetermined pressure P1 is applied to the left of the key 36. In the graph of FIG. 4A pressure P1 is shown. It is at this pressure that the envelope waveform shown in FIG. 4C commences. Note that in FIG. 3B the transducer 30 is still spaced from the key and thus is in its open condition. The contact 40 may be the switch contact that is typically provided in association with the keyboard. Keyboard and voltage divider arrangements of the type wherein one switch contact is associated with each key of the keyboard are well known in the art is conventional in the music synthesizer art.

In FIG. 3C the contact 40 is still in its closed condition but the key 36 has been depressed further under an increased pressure P2 so that the key now contacts the transducer 30 and from an electrical standpoint as shown in FIG. 2 the transducer switch 32 is closed.

Figure 4B:
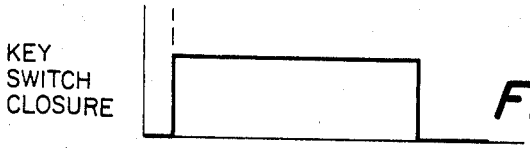
Figure 4C:
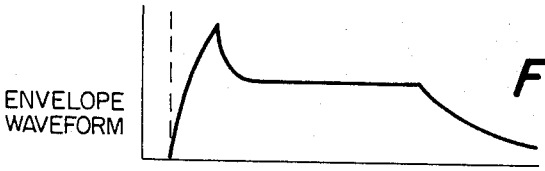
Figure 4D:
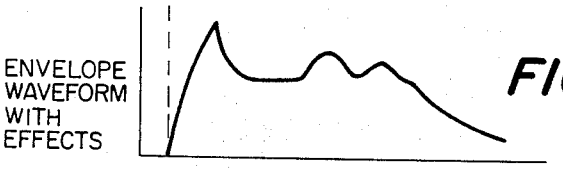

FIG. 4B shows the closure of contact 40. FIG. 4C shows the envelope that will be typically associated with the switch closure 40 wherein the attack of the envelope commences upon closure of the switch and the release commences upon an opening of the closure 40. FIG. 4D shows the envelope of FIG. 4C with the expressive effects added as controlled by and proportional to the added finger pressure.

Referring now to FIG. 2, many of the blocks shown therein are of conventional design. The system of FIG. 2 includes a keyboard controlling conventional electronic musical instrument circuits including a voltage divider 44, keyboard control circuit 48, envelope generator 50, voltage controlled oscillator(V.C.O.)52, voltage control filter(V.C.F.)56, voltage control amplifier(V.C.A.)60, power amplifier 62 and output speaker 66. The keyboard and voltage divider 44 may include a voltage divider and associated key actuated switches for respectively coupling voltage levels to the bus line 45. Keyboard and voltage divider 44 may be of conventional design and preferably includes a second output line 46 coupled from a top end of the resistor voltage divider to control circuit 48. When a key of the keyboard is depressed a corresponding voltage is coupled via line 45 to control circuit 48. When at least two keys are depressed or a key is released with another being held, a level change occurs on output line 46.

Control circuit 48 generates a control voltage signal on line 49 having a voltage level at any given time which is proportional to the position of the key that is actuated. This signal on line 49 controls the frequency of V.C.O. 52. The signal on line 49 first couples to summing circuit 51.

Control circuit 48 also generates a gate signal on line 48G and a trigger signal on line 48T both of which are coupled to envelope generator 50 which may be of conventional design. A gate signal is shown in FIG. 4B and is at its high state when a key is depressed and remains in this state as long as at least one key remains depressed. The gate signal controls the output of envelope generator 50 and generally sustains the signal transfer through another device such as voltage controlled filter 56. The output from envelope generator 50 couples to both VCF 56 and VCA 60 by way of respective summing circuits 55 and 61.

A typical output of envelope generator 50 is depicted in FIG. 4C and the particular waveform shown is controlled by the gate and trigger signals coupled to envelope generator 50. The attack time; initial decay time; and release time of the envelope generator output waveform may be conventionally controlled by R.C. time constant networks or the like of generator 50. As previously mentioned, the output from this generator is coupled to summing circuits 55 and 61.

FIG. 2 shows the three summing circuits 51, 55 and 61 all of which are substantially identical and of conventional design. Each of these circuits includes an operational amplifier 51A, 55A and 61A, respectively, and a plurality of input summing resistors. The input summing resistors are labelled 51B, 51C and 51D in circuits 51, 55B and 55C in circuit 55, and 61B and 61C in circuit 61, respectively.

The embodiment of the invention shown in FIG. 2 is somewhat different than the corresponding embodiment shown in FIG. 1. In FIG. 1 there is provided a single touch sensitivity controller 15 for controlling a number of touch sensitive effects as selected by array 16. Alternatively, in FIG. 2 there are a plurality of potentiometers 70–73 which provide indivdual control for different audible characteristics. In FIG. 2 only four audible characteristics are controlled; namely: vibrato, pitchbend, brilliance, and volume.

When the threshold pressure P2 has been applied to the key the switch 32 is closed and the variable resistor 34 is coupled from the battery 74 to the operational amplifier 76. The output of the operational amplifier 76 is a control voltage (Vct) that is proportional to the conductance of variable resistor 34. The output of the operational amplifier 76 connects to one side of the control potetiometers 70–73. By moving the wiper arm of any one of the these potetiometers to the ground side of the potetiometer the associated effect is inhibited. As the wiper arm is moved toward the (Vct) bus the degree of control increases. Thus, the audio characteristics shown in FIG. 2 can be controlled both by a variable setting of the potentiometers 70-73 and the pressure applied to the key itself.

FIG. 2 also shows a vibrato circuit 78 which includes a low frequency oscillator 80 and a voltage controlled amplifier 82. The voltage controlled amplifier 82 amplifies the low frequency signal from oscillator 80 which may be on the order of 6 hertz in frequency, and in accordance with a control input from the wiper arm of potentiometer 70. The output from amplifier 82 is coupled to input resistor 51C of circuit 51.

Line 49 from the keyboard control circuit 48 is connected to input resistor 51B of the circuit 51. The wiper arm from the potentiometer 71 is connected to input resistor 51D of the circuit 51.

If, for example, only the vibrato potentiometer 70 is adjusted away from its ground setting and if there is sufficient key pressure applied so that there is a control voltage level, then an output signal from amplifier 82 is summed with the control voltage signal on line 49 for providing a composite signal from the amplifier 51A which is coupled to the voltage controlled oscillator 52.

Alternatively, or in conjunction with the vibrato effect there can also be added a pitchbend by moving the potentiometer 71 from its ground setting to introduce a further variation into circuit 51. If the pitchbend characteristic is used alone this causes any note to slide up in pitch as it is played. The harder the note is pressed, the more the pitch will increase. This particular effect is extremely useful in duplicating many guitar, string, and some brass effects.

As previously mentioned, one of the outputs of the envelope generator 50 couples through input resistor 55B to summing circuit 55. Summing circuit 55 also receives another input from the brilliance potentiometer 72. When this potentiometer is moved from its grounded position different amounts of signal are coupled to circuit 55 depending also upon the value of the control voltage (Vct). This signal is summed with the signal from the output of the envelope generator and as indicated in FIG. 4D, a composite control voltage can be provided from amplifier 55A to filter 56 for controlling its output which is coupled to voltage controlled amplifier 60.

The other output from envelope generator 50 couples to through input resistor 61B summing circuit 61 which also receives an input by way of input resistor 61C from the volume potentiometer 73. The output of circuit 61 provides a composite control signal for the amplifier 60. By moving the potentiometer 73 away from its ground setting different volume ranges can be provided with the output from the speaker 66 being controllable of course also by applied pressure which varies the control voltage level.

In the other embodiment as shown in FIG. 1 the four potentiometers shown in FIG. 2 would be replaced by one single potentiometer and the wiper arm of this potentiometer would be coupled through a plurality of different switches which would individually couple to, for example, the summing circuits shown in FIG. 2.

Having described a limited number of embodiments of the present invention it should now become apparent to one skilled in the art that there are numerous other embodiments and modifications of the ones disclosed herein all of which are contemplated as falling within the spirit and scope of the present invention. For example, there have been disclosed a limited number of audio characteristic effects that are controlled. Obviously, there are many other effects such as wow or growl that could be controlled also. Moreover, there has been disclosed a particular system with which the concept of this invention is incorporated. There are many other systems however, that could employ the teachings of the present invention. For example, a system employing an envelope generator with a single input could incorporate the teachings of the present invention. What is claimed is:

1. For an electronic musical instrument having a keyboard, means coupled from the keyboard and responsive to a minimum key pressure for providing an audio signal, and means responsive to the audio signal for generating an audible tone corresponding to the played key, effect control means comprising;

transducer means operatively associated with the keyboard and having a conductance that is variable in accordance with pressure applied to a key of the keyboard, said transducer means being disposed relative to said keyboard so as to be operative only at applied pressure above a predetermined threshold pressure, which predetermined threshold pressure is greater than said minimum key pressure, means coupled from said transducer means for establishing a control level signal that is variable in accordance with pressure applied above said threshold pressure, a plurality of separate selection means each one for introducing a different audio effect, at least one of said selection means being selectable, each of said selection means being responsive to said control level signal and producing an audio effect signal that is variable in accordance with said control level signal, and means coupled from said selection means for altering said audio signal in accordance with at least one of said audio effect signals to thereby introduce the selected audio effect in the audible tone.

2. The means of claim 1 including variable means manually settable and coupled to said selection means for delimiting the range of variability of said audio effect signals.

3. The means of claim 2 wherein said variable means includes a plurality of manual adjusting means, one for each selection means.

4. The means of claim 1 wherein said means for providing said audio signal includes a switch contact which closes when said minimum key pressure is applied and wherein said transducer means includes spaced conductive strips, a variable conductance member and means for maintaining said member spaced from said strips under said minimum key pressure, said member contacting said strips when said predetermined threshold pressure is applied.

5. The means of claim 4 wherein said transducer means extends along the keyboard and is contactable by all keys of the keyboard.

6. The means of claim 1 wherein said altering means includes a summing circuit for summing at least one of said audio effect signals with said audio signal to produce a composite audio signal which is applied to said audible tone generating means.

* * * * *